United States Patent [19]

Kaineder et al.

[11] 3,951,423

[45] Apr. 20, 1976

[54] FRONT JAW FOR SAFETY SKI BINDINGS

[75] Inventors: Herbert Kaineder, Hundsheim; Josef Svoboda, Schwechat, both of Austria

[73] Assignee: Gertsch AG, Zug, Switzerland

[22] Filed: Sept. 19, 1974

[21] Appl. No.: 507,469

[30] Foreign Application Priority Data

Sept. 26, 1973 Austria ..... 8290/73

[52] U.S. Cl. ..... 280/629

[51] Int. Cl.[2] ..... A63C 9/08

[58] Field of Search ..... 280/11.35 T

[56] References Cited

UNITED STATES PATENTS

| | | | |
|---|---|---|---|
| 3,584,891 | 6/1971 | Khazzam | 280/11.35 T |
| 3,854,741 | 12/1974 | Marker | 280/11.35 T |
| 3,881,737 | 5/1975 | Senton | 280/11.35 T |

FOREIGN PATENTS OR APPLICATIONS

| | | | |
|---|---|---|---|
| 1,578,887 | 2/1966 | Germany | 280/11.35 T |
| 2,044,264 | 3/1970 | Germany | 280/11.35 T |
| 2,209,055 | 8/1973 | Germany | 280/11.35 T |
| 291,069 | 6/1971 | Austria | 280/11.35 T |
| 491,653 | 6/1970 | Switzerland | 280/11.35 T |

*Primary Examiner*—Robert R. Song
*Attorney, Agent, or Firm*—Woodhams, Blanchard and Flynn

[57] ABSTRACT

An improvement in a front jaw for a safety ski binding. A base plate and a base member are fixed together and have two axes thereon which are arranged perpendicularly to the base plate. Each axis pivotally supports a two-arm lever so that the longer lever arm engages the ski boot and the shorter lever arm engages a locking element which in turn engages a locking member movable against the force of a spring. The specific improvement is the utilization of a single locking member which is spring loaded and urged into engagement with a locking element. The locking element has a curved sector with differently inclined portions thereon so that as the curved sector moves relative to the locking element upon a swinging motion of the lever arms, the locking member will be moved against the spring resistance to a certain threshold point after which the lever arms will be permitted to move freely outwardly to facilitate a releasing function.

7 Claims, 8 Drawing Figures

FRONT JAW FOR SAFETY SKI BINDINGS

FIELD OF THE INVENTION

The invention relates to a front jaw for safety ski bindings having a base plate fixed to a ski, on which two axes are mounted and extend perpendicularly to the base plate. On each of the axes, a two-arm lever is pivotally supported so that the longer lever arms engage the ski boot, the shorter arms, however, engaging the locking element and further engage a locking member which is movable against the force of a spring.

BACKGROUND OF THE INVENTION

A ski binding part is known which has swingably supported two-arm levers. The shorter lever arms engage a so-called stroke reducer. This is a part onto which the spring acts and which is movable transversely of the direction of action of the spring, whereby inclined surfaces of the shorter lever arms slide on inclined surfaces of the stroke reducer. Such a construction is not only very expensive, but also easily susceptible to trouble. Furthermore, very high frictional forces occur between the movable stroke reducer, support with respect to the spring and the inclined surfaces of the lever arms. It must also be added that the ski boot, during a safety release, must practically force itself from the binding, because the spring force increases constantly with the increasing angle of traverse of the sole holder lever. Through this, there exists also the danger that the ski boot is jammed in a pivoted position.

Furthermore a ski binding part is known, which also engages the ski boot sole with two-arm levers. The shorter lever arms each carry a locking element, which is engaged by each one locking member which is loaded by a separate or by a common spring. In the one embodiment, two locking members, two locking springs and two adjusting screws are thus required in an expensive manner. A disadvantage must be mentioned at this point in that the release force of each lever must be adjusted separately and these two adjustments can be tuned with respect to one another only with great difficulty. In the case of the common spring load, the adjustment is possible with one single adjusting element, however, due to the construction, a so-called spring stack must be used, which consists of several leaf springs. This leaf spring stack loads two swingable levers, which carry the locking members, and engage the locking elements of the two-arm sole holder levers. Thus, the prior art deals with clearly expensive constructions which are complicated and, therefore, easily susceptible to trouble.

SUMMARY OF THE INVENTION

The purpose of the invention is now to avoid these disadvantages and to produce a front jaw, which is simple in structure and, therefore, inexpensive and hardly susceptible to trouble. This purpose is attained by providing one single locking member which is loaded by the spring and by constructing the locking element in a conventional manner as a curved sector or the like with differently inclined surface elements, the distance of which from the abutment of the spring remains the same or becomes greater starting with a certain angle of traverse of the levers. Thus one single locking member loaded by the spring and acting on both sole holder levers is sufficient. Due to the small number of parts, it is now also possible to construct the binding very small and space-savingly.

BRIEF SUMMARY OF THE DRAWINGS

The subject matter of the invention is illustrated in several exemplary embodiments in the drawings, in which.

DETAILED DESCRIPTION

Figure 1:
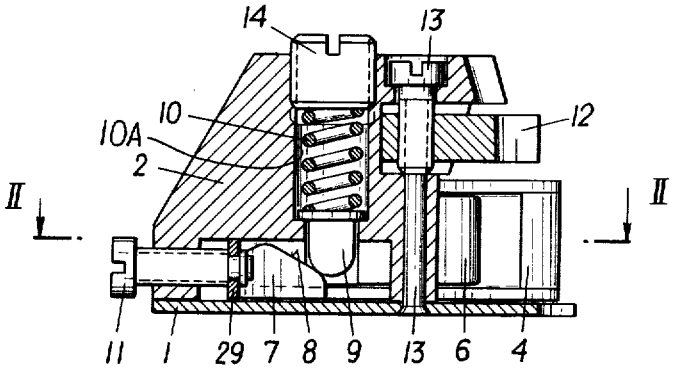
FIG. 1 is a central cross-sectional view of a front jaw.
Figure 2:
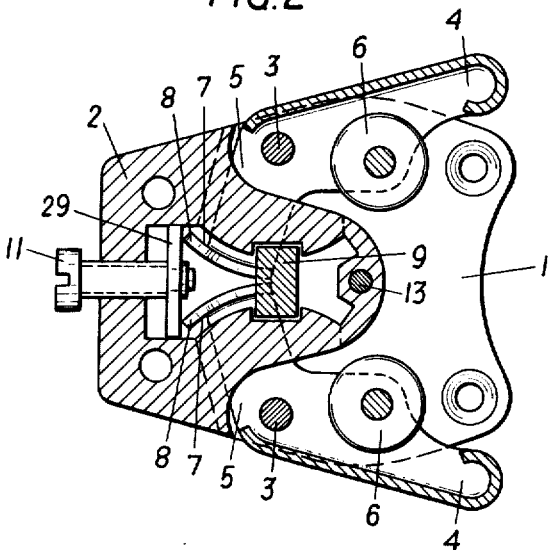
FIG. 2 is a cross-sectional view taken along the line II—II of FIG. 1.

As can be recognized from FIGS. 1 and 2, the front jaw has a base plate 1 and a base member 2, which parts are connected with one another. Base plate 1 and base member 2 have a pair of vertically arranged axes 3 thereon and on each axis there is pivotally supported two-arm levers 4,5. The longer lever arms 4 engage the ski boot sole while in a condition of use. In addition, support rollers 6 are rotatably supported on the longer lever arms 4 and are positioned to engage the ski boot sole while in the condition of use and to reduce, during a safety release, the friction occurring between the lever and the ski boot.

Upwardly directed flanges 7 are provided at the ends of the shorter lever arms 5, which flanges form curved sectors 8 along their upper edge. A locking member 9, which is movably guided for vertical movement in an opening 10A in the base member 2, is pressed by a spring 10 downwardly onto the upper edge of the curved sectors 8 of the flanges 7 to hold the two-arm levers 4,5 in the position of use. The flanges 7 are pressed in the position of use also against an adjustably movably supported stop 29 by the locking member 9, said stop 29 being movably adjusted in the base member 2 by means of a setscrew 11. By operating the screw 11, the two-arm levers 4,5 pivot about their axes 3, to facilitate an adjustment of the levers 4,5 to the various ski boot sole shapes.

The upper edge of the curved sectors 8 have variously inclined surface portions. As is particularly shown in FIG. 1, the upper edge of the curved sector 8 rises first to the left and drops off starting at a certain position. If a safety release takes place during which time the ski boot sole will effect a pivoting of one of the levers 4,5 outwardly about the axis 3, the upper edge of the curved sector 8 moves with the lever 4,5 and presses back with its rising surface the locking member 9 first against the force of the spring 10. As soon as the locking member 9 reaches highest point of the curved sector 8, the spring 10 will no longer be further compressed; at which time the moment of the release occurs. More specifically, no more force is required to effect a further pivoting of the lever 4,5 because the lever 4,5 will automatically pivot outwardly due to the locking member 9 being pushed by the spring 10 downwardly onto the dropping-off part of the curved sector 8. The locking member 9 will also simultaneously move along the dropping-off part of the curved sector 8. Thus a safe release function at the right moment is assured.

A sole holder 12 which grips over the ski boot sole is also provided on the base member 2, which sole holder 12 can be adjusted with respect to height by means of the screw 13 to facilitate an adjustment of the sole holder 12 to compensate for various thicknesses of ski boot soles. To adjust the release force, the locking spring 10 is supported at its upper end against an adjusting screw 14 threadedly engaged in the upper end of the opening 10A in the base member 2. By rotating the screw 14, the initial tension of the spring 10 is changed accordingly. It should also be mentioned that in this embodiment, if one of the levers 4,5 is pivoted so that it presses back the locking member 9 as has been described above, the other lever 4,5 is also released by the locking member due to the fact that the locking member has been raised from engagement therewith.

Figure 3:
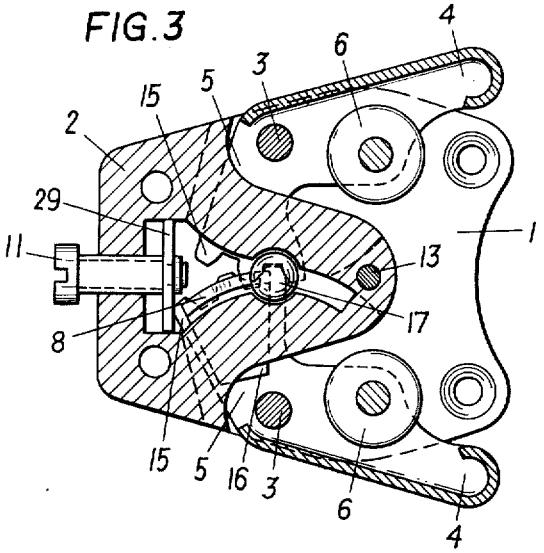
FIG. 3 is a cross-sectional view similar to FIG. 2 of an embodiment which has been changed slightly with respect to FIGS. 1 and 2.

FIG. 3 illustrates an embodiment which is similar to the first exemplary embodiment. Therefore, the same reference numerals have been used for those parts which are identical to the parts of FIGS. 1 and 2. The main difference is only that the shorter lever arms 5 of the two-arm levers 4,5 engage one another through teeth 15 arranged at the ends of the shorter lever arms 5. If one of the levers 4,5 is pivoted about its axis 3, the other arm will also automatically pivot through the toothed connection 15.

By coupling the two levers 4,5 through the toothed connection 15, only one single curved sector 8 is required, which is formed at the end of a bent flange 16 which is connected to one of the levers 4,5. The locking member can be formed in a simple manner by a locking ball 17, which engages the upper edge of the curved sector 8 on the flange 16. The operation during a safety release is the same as was described in connection with the first exemplary embodiment. Only if one of the lever arms 4,5 is pivoted, the second lever arm, as already mentioned, is pivoted through the toothed connection 15.

Figure 4:
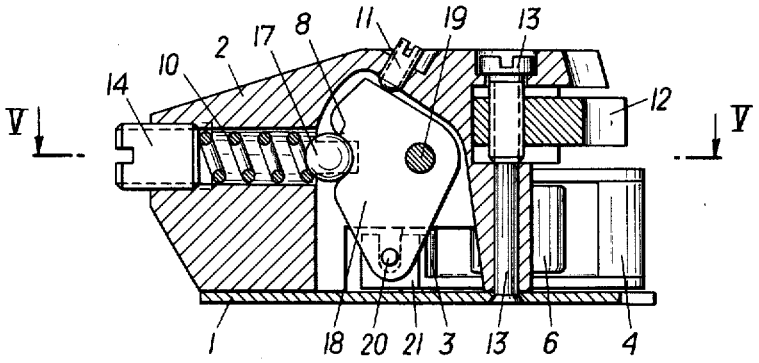
FIG. 4 is a central cross-sectional view of a further embodiment.
Figure 5:
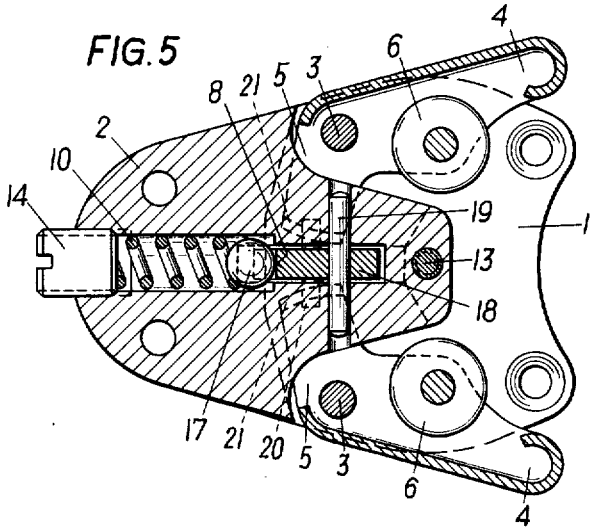
FIG. 5 is a cross-sectional view taken along the line V—V of FIG. 4.

In the embodiment of FIGS. 4 and 5, the base plate 1 and the base member 2 are again connected to one another and support vertical axes 3 about which two-arm or toggle levers 4,5 are pivotally supported. A locking element 18 having frontwardly and rearwardly facing edges is pivotally arranged about a horizontal axis 19 on the base member 2. The horizontal axis is positioned perpendicular to the longitudinal axis of the ski. A locking ball 17, which is movable in the base member 2 and is loaded by the spring 10, engages the front edge or curved sector 8 of the locking element 18. The locking element 18 has lateral extensions 20 which are received between a pair of upstanding fork-shaped constructed flanges 21 on the ends of the shorter lever arms 5.

If one of the levers 4,5 is pivoted, the locking element 18 is also pivoted about the axis 19 due to a movement of the flanges 21 and extension 20. The locking ball 17 will thereby be moved to compress the locking spring 10 until the locking ball 17 reaches the highest point of leftwardmost zone of the curved sector 8. Thereafter, the curved sector drops off again to the right so that the locking spring 10 which begins to slightly relax to effect a pivoting of the locking element 18 further and, through this, the lever 4,5 is moved automatically to the completely open position.

As soon as lever 4,5 is pivoted, the second lever automatically pivots also in this construction, because it is connected to the first lever through the fork-shaped flanges 21 and extension 20 of the locking element 18. The locking element 18 is urged by the spring 10 about the pivot 19 into engagement with an adjusting screw 11. If the adjusting screw 11 is rotated and thereby moved axially, the locking element 18 and also the levers 4,5 will also be moved, about the axis of the pivot 19 to facilitate an adjustment of the levers 4,5 to the various shapes of ski boot soles. The initial tension of the spring 10 and, therefore, the release moment can be adjusted by means of the screw 14. The sole holder 12 can be adjusted in height by means of the screw 13 in order to compensate for the various thicknesses of the ski boot sole.

Figure 6:
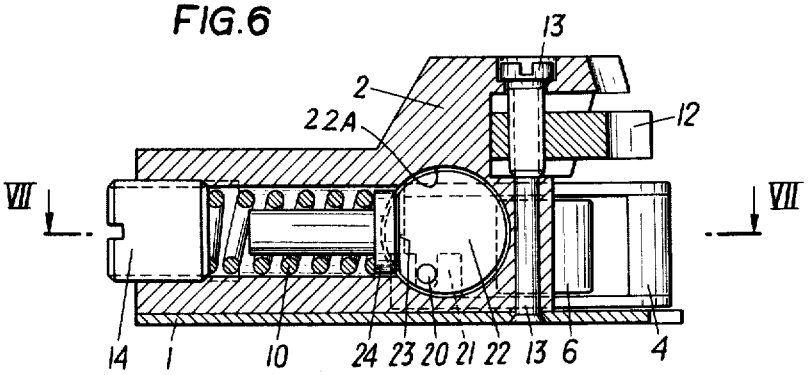
FIG. 6 is a central cross-sectional view of another embodiment.
Figure 7:
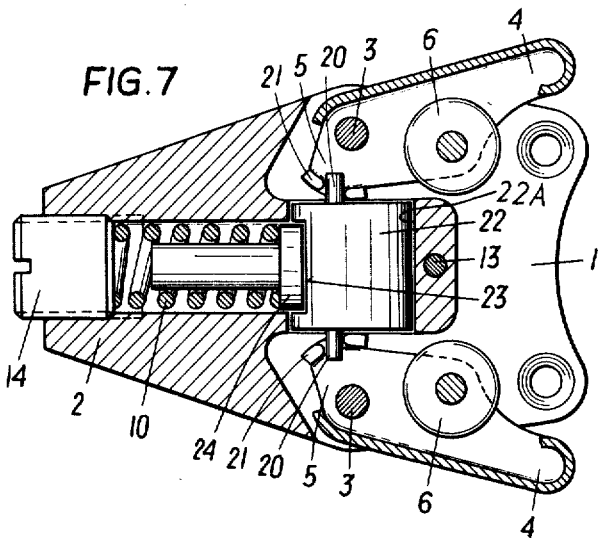
FIG. 7 is a cross-sectional view taken along the line VII—VII of FIG. 6 and finally

FIGS. 6 and 7 illustrate a design which is similar to the embodiment illustrated in FIGS. 4 and 5. The locking element 22 is cylindrical in shape and is rotatably supported for movement about its axis in a bore 22A in the base member 2. The locking member is constructed as a piston 24 having a flat face thereon which is spring loaded by the spring 10 into engagement with a flattened portion 23 on the periphery of the locking element 22. The locking element 22 has in the same manner as in the above exemplary embodiment extensions 20 received between the fork-shaped flanges 21 mounted on the lever arms 5.

During a swinging out of one lever arm, the locking element 22 is rotated about its axis caused by a movement of the fork-shaped flanges 21 and the extension 20. The upper edge of the flattened portion 23 of the locking element 22 urges thereby the locking member, which is constructed as a piston 24, back to the left against the force of the spring 10. During such a swinging motion of the lever 4,5, the outer cylindrical periphery of the locking element 22 contacts the face of the piston 24 and the spring force from the spring 10 is rendered ineffective and the lever 4,5 can easily swing out further.

Figure 8:
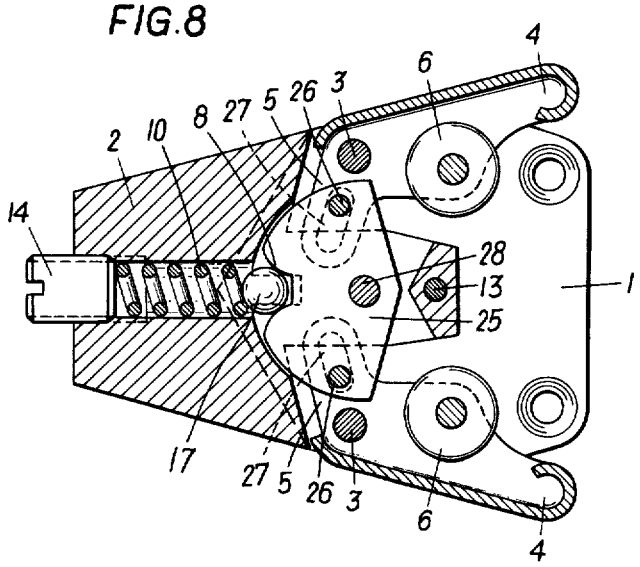
FIG. 8 is a cross-sectional view of a further exemplary embodiment.

In FIG. 8, a locking ball 17, which is movably supported in the base member, is pressed by the spring 10 against the curved sector 8 of a locking element 25, which is pivotally supported for movement about a vertical pivot axis 28. The locking element 25 has vertically extending extensions 26, which are received in longitudinal slots 27 provided in the shorter lever arms 5. By swinging a lever arm 4,5 outwardly, the locking element 25 is rotated about the pivot axis 28 due to the pin-slot connection 26,27. The locking ball 17 is thereby pressed back against the force of the spring 10 by the curved sector 8 namely, the leftwardly projecting portion until the highest leftwardly projecting point is reached. This point is the release point and the lever can now easily be further swung outwardly.

The extensions 26 of the locking element 25 are arranged offset with respect to the pivot axis 28 such that they lie practically on an arc which is concentric with respect to the pivot axis 28 and which is smaller than 180°. Due to this arrangement, during a swing of one of the two-arm levers 4,5 outwardly, the second two-arm lever, which in the same manner is coupled to the locking element 25, will swing inwardly, however, the angle of traverse of the inwardly swinging two-arm lever 4,5 will always be smaller than the outward swing of the other. Thus, both levers swing in the same direction, but since the one lever swings quicker, the levers 4,5 become more spaced. Also through the inclination of the longitudinal slots 27 toward the pivot axis 28 of the locking element 25, the swivel movements of the two levers 4,5 with respect to one another are altered.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A front jaw in safety ski bindings for holding a ski boot onto a ski, comprising:

base means mounted on said ski and having a pair of horizontally spaced vertical posts fixedly secured thereto;

a two-arm lever pivotally mounted on each of said vertical posts for movement between a ski boot engaging and a ski boot releasing position, each two-arm lever having a long arm adapted to engage said ski boot and a short arm, both of said short arms having cam means connected thereto and movable therewith, said cam means on each short arm of each two-arm lever including an upright curved flange connected thereto and movable therewith, the axis for said curved flange coinciding with the axis of the corresponding one of said posts, each of said upright flanges having a contoured upper edge; and resilient locking means mounted on said base means and consisting of a single elongated spring and a single locking member, the longitudinal axis of said spring being immovably fixed to said base means, said spring resiliently urging said locking member into engagement with said upper edges of both of said upright flanges when said two-arm levers are in said ski boot engaging position, the spacing between one of said contoured edges and an abutment for said spring becoming smaller as at least one of said two-arm levers is swung from said ski boot engaging position toward said ski boot releasing position, said spring backed locking member resisting a lateral pivotal movement of said two-arm levers toward a ski boot releasing position whereby a pivotal movement of one of said two-arm levers toward said ski boot releasing position will effect a movement of said locking member toward said abutment to thereby lift said locking member from engagement with the other one of said upright flanges on the other one of said two-arm levers.

2. A front jaw according to claim 1, wherein the pair of two-arm levers are each supported for pivotal movement independent of each other.

3. A front jaw according to claim 1, wherein said cam means are integrally secured to said short arms.

4. A front jaw in safety ski bindings for holding a ski boot onto a ski, comprising:

base means mounted on said ski and having a pair of horizontally spaced vertical posts fixedly secured thereto;

a two-arm lever pivotally mounted on each of said vertical posts for movement between a ski boot engaging and a ski boot releasing position, each two-arm lever having a long arm adapted to engage said ski boot and a short arm, at least one of said short arms having cam means connected thereto and movable therewith, said cam means having a contoured edge thereon; and resilient locking means mounted on said base means and consisting of a single elongated spring and a single locking member, the longitudinal axis of said spring being immovably fixed to said base means and parallel to the axes of said vertical posts, said spring resiliently urging said locking member into engagement with said contoured edge of said cam means, the spacing between said contoured edge and an abutment for said spring becoming smaller as at least one of said two-arm levers is swung from said ski boot engaging position toward said ski boot releasing position, said spring backed locking member resisting a lateral pivotal movement of said two-arm levers toward a ski boot releasing position.

5. A front jaw according to claim 4, wherein each of said short arms has gear teeth thereon;

wherein said gear teeth are in direct engagement with each other whereby a pivotal movement of one of said two-arm levers will effect a simultaneous movement of both of said two-arm levers.

6. A front jaw according to claim 5, wherein the longitudinal axis of said spring is parallel to the axis of said vertical posts.

7. A front jaw according to claim 4, wherein said cam means are integrally secured to said short arms.

* * * * *